US007213794B1

(12) United States Patent
Jefferies

(10) Patent No.: US 7,213,794 B1
(45) Date of Patent: May 8, 2007

(54) BOOK STAND

(76) Inventor: Flavius N. Jefferies, ITT Industries, Eagle Base (AE) 09789

( * ) Notice: Subject to any disclaimer, the term of this patent is extended or adjusted under 35 U.S.C. 154(b) by 381 days.

(21) Appl. No.: 10/967,680

(22) Filed: Oct. 18, 2004

(51) Int. Cl.
*A47B 97/04* (2006.01)

(52) U.S. Cl. ..... 248/460; 248/447; 248/453; 248/458; 248/459

(58) Field of Classification Search ..... None
See application file for complete search history.

(56) References Cited

U.S. PATENT DOCUMENTS 3,127,114 A 3/1964 Shaw
4,036,465 A * 7/1977 Kellner ..... 248/463
4,127,253 A 11/1978 Ben-Lea
4,482,185 A * 11/1984 Zoellner ..... 297/135
4,753,408 A * 6/1988 Wailes ..... 248/371
5,025,353 A 6/1991 Menaged
5,725,192 A * 3/1998 Cloninger ..... 248/458
5,833,178 A * 11/1998 Plasse et al. ..... 248/27.8
5,915,661 A * 6/1999 Silverman et al. ..... 248/465.1
6,186,593 B1 * 2/2001 Garneau ..... 297/188.01

* cited by examiner

*Primary Examiner*—Carl D. Friedman
*Assistant Examiner*—Steven Marsh
(74) *Attorney, Agent, or Firm*—Crossley Patent Law; Mark A. Crossley

(57) ABSTRACT

A foldable book stand for viewing written materials, music and the like or for writing upon same, the stand is further fitted with a battery powered lamp. The preferred embodiment measures about 4 inches square in folded state. The stand is fitted with articulation joints that hold it in the desired shape through tension and friction. The stand is further fitted with brackets for supporting materials and bracket tabs for holding pages in place.

19 Claims, 3 Drawing Sheets

BOOK STAND

FIELD OF THE INVENTION

This invention relates specifically to stands and holders for books, music, or other types of self-contained articles or objects for viewing.

BACKGROUND OF THE INVENTION

While many and varied stands are available for viewing books, music and the like, most address only some of the needs of personal document support or illumination. A device is needed which not only supports materials to be viewed, but also keeps items on a particular chosen page and illuminates the items only, and not a surrounding area. Further, such a device better serves if it is collapsible so that it can be stored compactly when not in use.

DESCRIPTION OF THE PRIOR ART

Holders for items and documents to be viewed include a variety of devices for temporarily securing and illuminating the articles. None, however, offer the particular advantages of the present invention. By way of example:

U.S. Pat. No. 4,127,253 issued to Ben-Lea on Nov. 28, 1978 discloses a holder for books and music and the like, the holder comprising a stand with spring-loaded mechanism for holding objects at their lower edge. The device's primary objective to clamp pages securely, such as music pages, differs from the wide-range intent of the present invention, as does the overall design.

U.S. Pat. No. 3,127,114 issued to Shaw on Mar. 31, 1964 discloses a lighted book stand for use with or as a music rack, bookstand, or easel. The device focuses on attachment to an existing structure, thereby affording an adjustable plane of light source for viewing said articles.

U.S. Pat. No. 5,025,353 issued to Menaged on Jun. 18, 1991 discloses a freestanding device for securing articles to be viewed, and a light source for their viewing. The design, appearance and function are unlike the present invention.

While the above-described devices fulfill their respective and particular objects and requirements, they do not describe an improved book stand that provides for the advantages of the present invention. Therefore, a need exists for an improved book stand, particularly one that includes the foldable compactness, utility, and battery powered personal light of the improved book stand. In this respect, the present invention substantially departs from the conventional concepts and designs of the prior art.

SUMMARY OF THE INVENTION

In view of the foregoing disadvantages inherent in the known types of book stands now present in the prior art, the improved book stand overcomes the above-mentioned disadvantages and drawbacks or the prior art. As such, the general purpose of the book stand, described subsequently in greater detail, is to provide a book stand which has all of the advantages of the prior art mentioned heretofore and many novel features that result in an improved book stand which is not anticipated, rendered obvious, suggested, or even implied by the prior art, either alone or in combination thereof.

To accomplish this, the book stand is comprised of a foldable shape, which when folded is planar, substantially flat and compact. When folded, or collapsed, the book stand is about 4 inches square, in one embodiment. When fully unfolded the book stand is about 12 inches in length and 4 inches wide with an angled surface for holding books, music or other items for viewing. Supporting legs are therefore about 4 inches long. Further, in this embodiment, there are three columns per side that unfold from the collapsed dimension of about 4 inches to a supporting length of about 12 inches. An alternate embodiment has only two columns per side, each column of about 6 inches and legs about 6 inches long such that the collapsed dimensional length is about 6 inches and the unfolded supporting length about 12 inches. This embodiment is also about 4 inches wide and therefore forms a substantially flat rectangle when folded.

A pivotal light resides in the top center position of the book stand. The light not only articulates for height above the viewed materials, but also has a pivoting lamp shade for further light control. Light is provided by a battery lit lamp. Two AAA replaceable batteries provide power. The book stand is therefore suited to lighting only what is to be viewed, and not surrounding areas. The book stand is therefore used for personal viewing and is not a distraction to others. The book stand may be rested upon any desired surface. And, the legs are fitted with pads for cushioning the stand relative to that surface and for holding the stand in position by way of friction. Further, the preferred embodiment also features pads on the lower transverse that perform the same function as those on the legs.

Articulation joints of the book stand are fitted with pivots that tensionally and frictionally maintain the desired shape of the stand, whether folded or unfolded, until a user wishes to change that shape. Preferred construction is plastic, although other embodiments of the book stand are constructed of wood and other suitable materials. In the preferred plastic construction, the book stand offers the least expensive and most portable embodiment. The book stand also provides materials support brackets for holding materials to be viewed, and the brackets further contain tabs for holding pages to the positions desired.

By affording hands-free viewing and locatable light, the book stand eases eye strain as well as fatigue that might be experienced when having to hold materials. The small, personal lamp provides no intrusion to others. Military barracks situations, for example, provide an ideal example of the book stand's use. Reading or viewing materials without offending others by turning on lights is advantageous. Also, the small lamp does not build up heat. The book stand may also be offered with bookmarks included. As the stand folds into such small shapes, it is easily transported and stored.

Thus has been broadly outlined the more important features of the book stand so that the detailed description thereof that follows may be better understood and in order that the present contribution to the art may be better appreciated.

Numerous objects, features and advantages of the book stand will be readily apparent to those of ordinary skill in the art upon reading the following detailed description of presently preferred, but nonetheless illustrative, embodiments of the book stand when taken in conjunction with the accompanying drawings. In this respect, before explaining the current embodiments of the book stand in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the book stand. It is therefore important that the claims be regarded as including such equivalent constructions insofar as they do not depart from the spirit and scope of the present invention.

An object, then, of the book stand is to provide a stand that includes an articulating, battery powered light that is not obtrusive to surrounding areas or people.

It is an additional object of the book stand to provide hands-free support of materials to be viewed.

An added object of the book stand is to provide a stand that can be folded into a small substantially flat shape when not in use.

Additionally, it is an object of the book stand to be manufactured in more than one embodiment, the varied embodiments differing in the number and length of their columns.

These together with additional objects of the book stand, along with various novel features that characterize the invention are particularly pointed out in the claims forming a part of this disclosure. For better understanding of the book stand, its operating advantages and specific objects attained by its uses, refer to the accompanying drawings and description.

DETAILED DESCRIPTION OF THE PREFERRED EMBODIMENT

Figure 1:
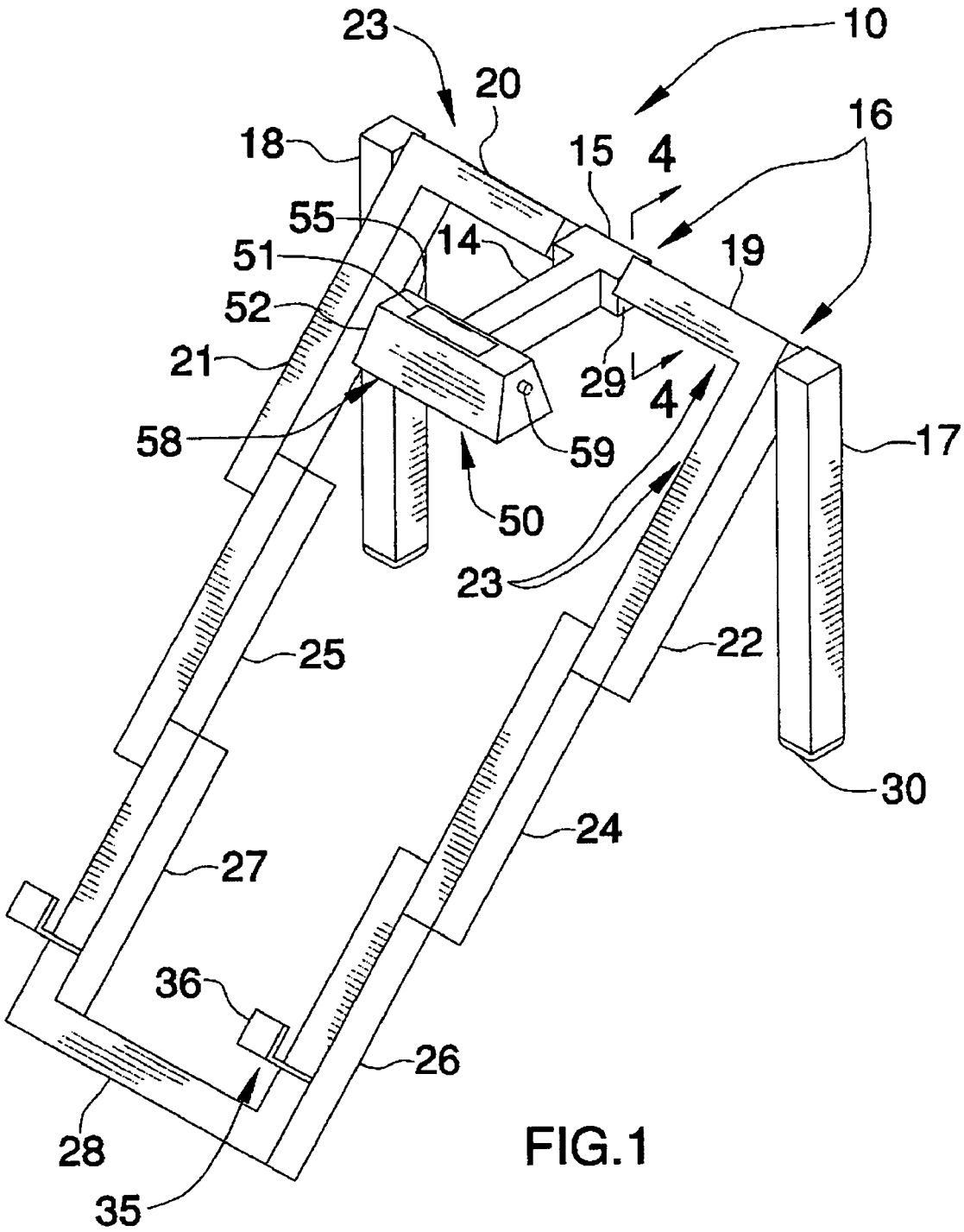
FIG. 1 is a perspective view of the book stand.

With reference now to the drawings, and in particular FIGS. 1 through 4 thereof, the preferred embodiment of the book stand employing the principles and concepts of the present invention and generally designated by the reference number 10 will be described.

Book stand 10 comprises a foldable assembly further comprised of right support leg 17 and left support leg 18. Legs 17 and 18 are about 4 inches long. At lower ends of legs 17 and 18 are fitted leg pads 30, for cushioning and position retention by surface friction. Upper ends of support legs 17 and 18 are affixed by friction pivots 40 to tops of inverted L members 23 and thereby form articulation joints 16. Right L member 23 is comprised of right transverse 19 and right column 22. Left L member 23 is comprised of left transverse 20 and left column 21. Articulation joint 16 of leg 17 and right L member 23 is positioned at the uppermost interior end of leg 17 contacting the outer surface of right L member 23 where right transverse 19 meets right column 22. Articulation joint 16 of leg 18 and left L member 23 is positioned at the uppermost interior end of leg 18 contacting the outer surface of left L member 23 where left transverse 20 meets left column 21. Midway between left and right L members 23 is pivoting T member 15 of lamp support arm 14. T member 15 on one end of arm 14 is attached by friction pivot 40 to interior-most surfaces of transverse 19 and transverse 20. The dimension from exterior surface of leg 17 through transverse 19, then T member 15, thence through transverse 20, and to the exterior of leg 18 is about 4 inches.

Figure 2:
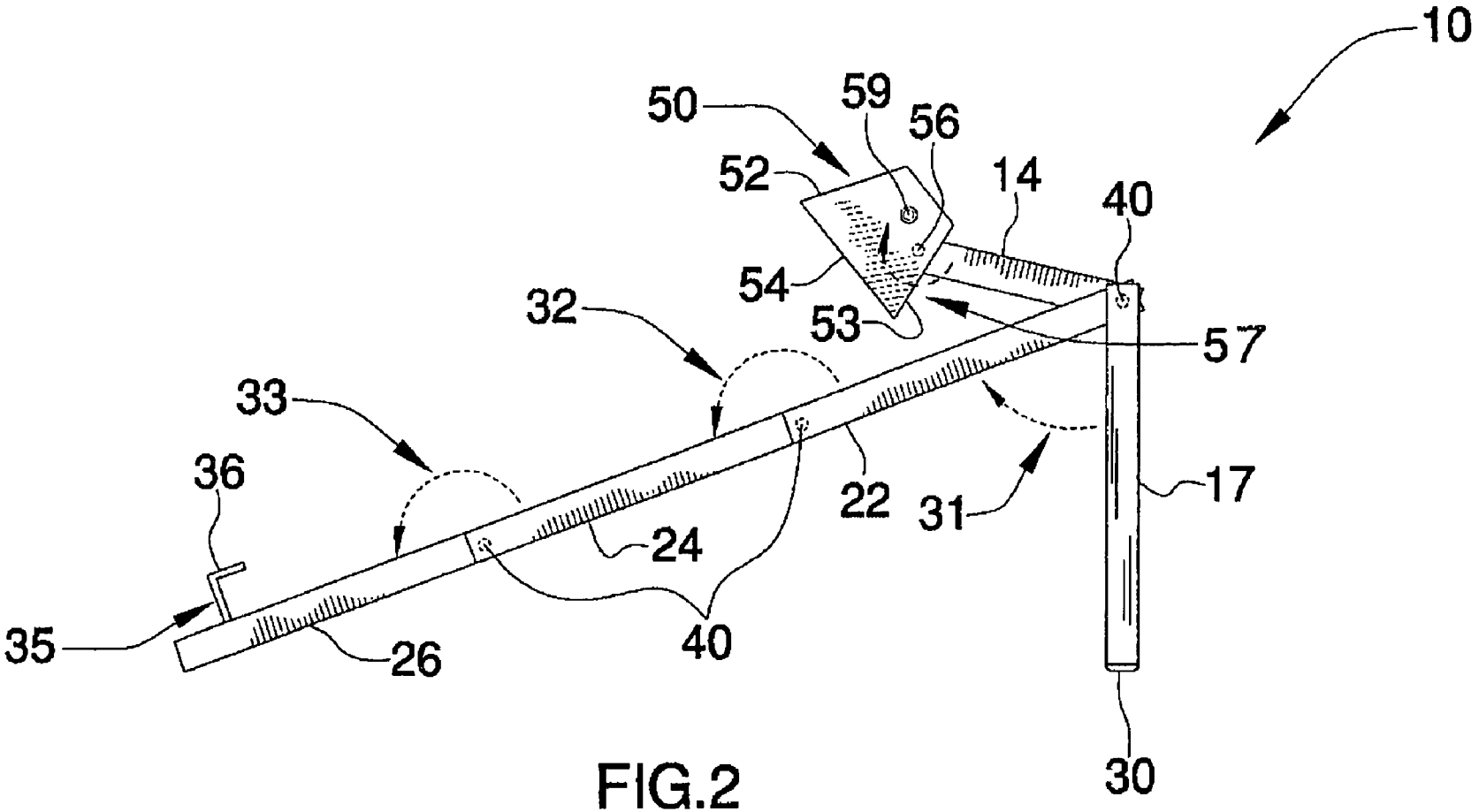
FIG. 2 is a side view of the book stand.
Figure 3:
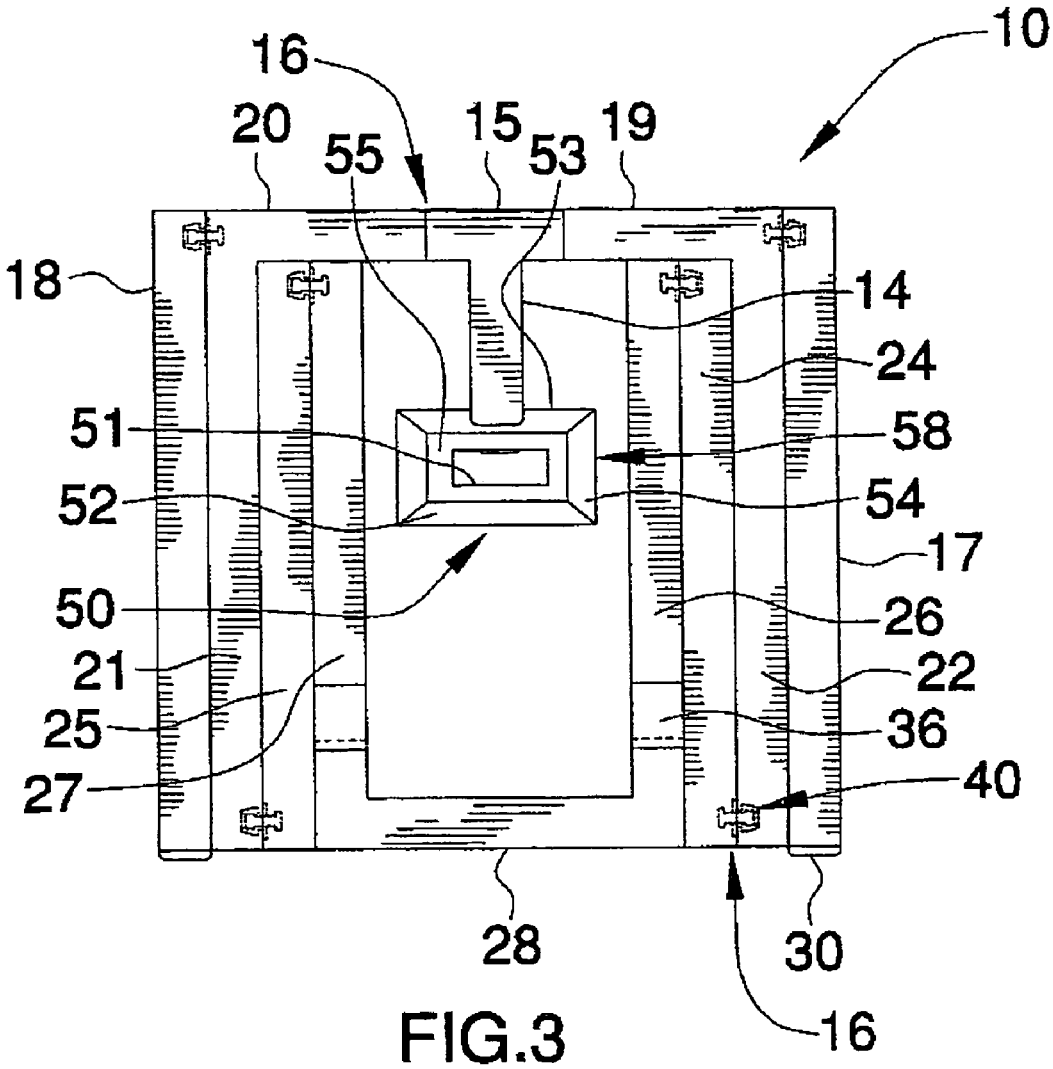
FIG. 3 is a top view of the book stand in the folded state.

Referring to FIG. 3, other end of arm 14 supports lamp 50 via lamp pivot 56. Pivot 56 provides for lamp 50 to pivot about arm 14 throughout an arc 57 of about 45 degrees (FIG. 2). Lamp 50 is further comprised of shade top 55 that contains, rectangularly disposed in the center, battery access 51. Angling slightly forward and downward from top 55 is forward shade 52. Opposite shade 52, rear shade 53 angles slightly outward and downward from top 55. Shades 52 and 63 are laterally connected by trapezoidal side shades 54. Top 55, forward shade 52, rear shade 53, and side shades 54 thereby form lamp shade 58.

Figure 4:
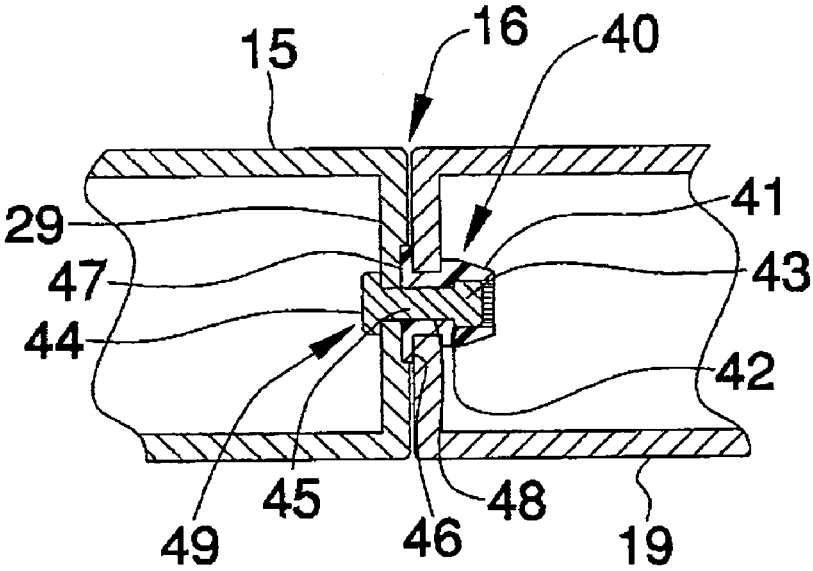
FIG. 4 is a cross sectional view of an articulation joint of the book stand.

Referring again to FIG. 1, book stand 10 is further comprised of right center column 24 and left center column 25. Uppermost outer surface of column 24 pivotally attaches to lower inner surface of right column 22 of right L member 23 by way of articulation joint 16 (FIGS. 2 and 4). Interior surface of lower end of right column 24 pivotally attaches to upper exterior surface of right lower U column 26 via pivot 40 of articulation joint 16. From thence right lower U column 26 extends downward to join to lower transverse 28, forming a right angle therewith. Transverse 28 extends laterally to meet, at an opposing right angle, left lower U column 27. From thence, column 27 extends upwardly to meet on upper and outer exterior surface, lower interior surface of left center column 25. Columns 27 and 25 join at articulation joint 16 via pivot 40.

Column 25 is a mirror image of column 24. Upper exterior surface of column 25 joins lower interior surface of column 21 at joint 16 by pivot 40.

Referring to FIGS. 1 and 2, right column 22, angularly extends from first articulation angle 31 downward to meet right center column 24. Column 22 and column 24 pivotally meet to form second articulation angle 32. Column 24 extends downwardly to meet right lower U column 26 and joins to form, in the unfolded extended state of invention 10, third articulation angle 33. Angles 32 and 33 are, in invention 10 extended state, 180 degrees. Columns 22, 24 and 26 are thereby coplanar. Likewise, left column 21 joins left center column 25, and column 25 joins left lower U column 27 to also be coplanar to themselves and to columns 22, 24, and 26. The angular upwardly facing platform thereby formed from columns 21, 25, 27, 26, 24, and 22 provides a surface for resting books (not shown), music (not shown), or any other material chosen for viewing (not shown) or even for writing upon. Materials support brackets 35 are upwardly and forwardly disposed from the lower ends of columns 26 and 27 to support chosen materials. Further, bracket tabs 36 hold pages of materials open to pages chosen by a user (not shown).

Referring to FIG. 4, articulation joint 16 is comprised of pivotal joining of interior end surface of right transverse 19 to exterior right end surface of T member 15. Pivot 40 tensionally and frictionally maintains pivotal positions of transverse 19 and member 15. Within insert orifice 48 of transverse 19 is fitted insert 41. Exterior end surface of T member 15 is constructed with insert recession 46 designed to receive insert flange 47 of insert 41.

Insert shoulder 42 of insert 41 is designed to receive expansion nodule 43 on one end of shaft 45 of pin 49. On opposite end of shaft 45 of pin 49 is head 44. Head 44 is held snugly against end of T member 29. Pivot 40 thereby securely retains chosen positioning of articulation joints 16 by way of tension and friction.

Referring to FIG. 3, invention 10 is in a folded, or collapsed, state. Invention 10 is thereby a substantially planar square of about 4 inches per side. Right support leg 17 is identical in length to outer surface of right column 22. Inner surface of column 22 is equal in length to column 24. Column 24 is equal in length to outer surface of right lower U column 26. Likewise, leg 18 is identical in length to outer surface of left column 21. Inner surface of column 21 is equal in length to left center column 25. Center column 25 is identical in length to outer surface of left lower U column 27. Articulation joints 16 of T member 15 and corresponding transverses 19 and 20 provide for pivot of member 15 and hence arm 14. This provides not only for adjustment but also the subsequent fit of lamp 50 within the interior surfaces of columns 26 and 27 when stand 10 is folded. Lamp pivot 56 provides for lower edges of shades 52 and 53 to pivot to preferred position. These pivotal features therefore also provide that invention 10 is selectively substantially flat for transport or storage.

For use, legs 17 and 18 are pivoted about L members 23 to form angle 31. Columns 24 and 25 are pivoted from columns 22 and 21 to form angle 32 of 180 degrees. Lower transverse 28 is grasped and unfolded pivotally to form angle 33 of 180 degrees and to position columns 26 and 27 coplanar to columns 24 and 25. Combined length of unfolded columns 22, 24, and 26 is about 12 inches. Combined length of columns 21, 25, and 27 is about 12 inches. Arm 14 is pivoted to position as desired. Lamp 50 is pivoted about arc 57 via lamp pivot 56. Battery access 51 is removed from shade top 55 to install two AAA batteries (not shown) within lamp 50. Access 51 is then refitted. Lamp switch 59 is twisted to turn on lamp 50.

Desired materials are placed upon upper surface of columns 21, 22, 24, 25, 26, and 27. Materials are restrained by materials support bracket 35 and bracket tabs 36 such that any pages (not shown) remain open as placed. Invention 10 may be rested on any desired surface (not shown). Cessation of use of invention 10 provides for reversal of the above procedure such that invention 10 is returned to substantially flat profile for transport or storage.

With respect to the above description then, it is to be realized that the optimum dimensional relationships for the parts of the book stand, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A foldable stand for holding materials for viewing or writing upon, said stand comprising right and left inverted L members that form articulation joints with right and left legs respectively;

an upper inner surface of said right leg articulating with an outer surface of said right inverted L member, the articulation joint disposed where a right transverse of said L member meets a right column of said L member;

an upper inner surface of said left leg articulating with an outer surface of said left inverted L member, the articulation joint disposed where a left transverse of said L member meets a left column of said L member;

an upper outer surface of a right center column that forms an articulation joint with a lower inner surface of said right column of said right inverted L member;

an upper outer surface of a left center column that forms an articulation joint with a lower inner surface of said left column of said left inverted L member;

an upper outer surface of a right lower U column that forms an articulation joint with an inner lower surface of said right center column;

a lower transverse that rigidly connects a left lower U column to said right lower U column;

an upper outer surface of said left lower U column that forms an articulation joint with a lower inner surface of said left center column, said articulation joints thereby providing for folding said foldable stand into a planar square.

2. The invention in claim 1 wherein said articulation joints are comprised of pivots that hold said foldable stand in a desired shape.

3. The invention in claim 2 wherein a lamp is fitted to said foldable stand.

4. The invention in claim 3 wherein said lamp is battery powered.

5. The invention in claim 4 wherein said lamp is disposed between said right inverted L member and said left inverted L member.

6. The invention in claim 5 wherein a support arm of said lamp is connected to a T member on one end and said lamp on the other, said support arm between said T member and said lamp, said T member forming articulation joints with said right transverse of said right inverted L member and said left transverse of said left inverted L member, thereby providing selective pivoting of said support arm.

7. The invention in claim 6 wherein said lamp further comprises pivoting means for said lamp to pivot about said support arm.

8. The invention in claim 7 wherein materials support brackets are affixed to lower upper surfaces of said right lower U column and said left lower U column.

9. The invention in claim 8 wherein said materials support brackets are fitted with bracket tabs for holding pages of said materials.

10. The invention in claim 9 wherein said pivot and said articulation joint further comprise an insert orifice for receiving an insert with an insert shoulder on one end and an insert flange on the other;

a pin with a head on one end and an expansion nodule on the other, said pin's head butting against an inside of an opposing column or member of said articulation joint;

said expansion nodule fitting within said insert shoulder of said insert of said opposite column or member;

an insert recession in an outer surface of said opposing column or member flushly receiving said insert flange whereby a tensioned, friction articulation of said articulation joint is formed.

11. A foldable stand for holding materials for viewing or writing upon, said stand comprising right and left inverted L members that form articulation joints with right and left legs respectively, said upper inner surface of said right leg articulating with an outer surface of said right inverted L member where a right transverse of said L member meets a right column of said L member;

an upper inner surface of said left leg articulating with an outer surface of said left inverted L member where a left transverse of said L member meets a left column of said L member;

an upper outer surface of a right center column forming an articulation joint with a lower inner surface of said right column of said right inverted L member;

an upper outer surface of a left center column forming an articulation joint with a lower inner surface of said left column of said left inverted L member;

an upper outer surface of a right lower U column forming an articulation joint with an inner lower surface of said right center column;

a lower transverse that rigidly connects a left lower U column to said right lower U column;

an upper outer surface of said left lower U column forming an articulation joint with a lower inner surface of said left center column, said articulation joints thereby providing for folding said foldable stand into a planar square, said articulation joint further comprising an insert orifice for receiving an insert with an insert shoulder on one end and an insert flange on the other, said insert fitting into one column or one member of said articulation joint;

a pin with a head on one end and an expansion nodule on the other, said pin's head butting against an inside of an opposing column or member of said articulation joint, said expansion nodule fitting within said insert shoulder of said insert of said opposite column or member;

an insert recession in an outer surface of said opposing column or member flushly receiving said flange whereby a tensioned, friction articulation of said articulation joint is formed.

12. The invention in claim 11 wherein said foldable stand further comprises a lamp.

13. The invention in claim 12 wherein said lamp is battery powered.

14. The invention in claim 13 wherein said lamp is disposed between said right inverted L member and said left inverted L member.

15. The invention in claim 14 wherein a support arm of said lamp is connected to a T member on one end and said lamp on the other, said support arm between said T member and said lamp, said T member forming articulation joints with said right transverse of said right inverted L member and said left transverse of said left inverted L member, thereby providing for pivot of said support arm.

16. The invention in claim 15 wherein said lamp further comprises pivoting means for said lamp to pivot about said support arm.

17. The invention in claim 16 wherein materials support brackets are affixed to lower upper surfaces of said right lower U column and said left lower U column.

18. The invention in claim 17 wherein said materials support brackets further comprise bracket tabs for holding pages of said materials.

19. A foldable stand for holding materials for viewing or writing upon, said stand comprising right and left inverted L members that form articulation joints with right and left legs respectively, said upper inner surface of said right leg articulating with an outer surface of said right inverted L member where a right transverse of said L member meets a right column of said L member;

an upper inner surface of said left leg articulating with an outer surface of said left inverted L member where a transverse of said L member meets a left column of said L member;

an upper outer surface of a right lower U column forming an articulation joint with an inner lower surface of said right column;

a lower transverse that rigidly connects a left lower U column to said right lower U column;

an upper outer surface of said left lower U column forming an articulation joint with a lower inner surface of said left column, said articulation joints thereby providing for folding said foldable stand into a planar rectangle, said articulation joint further comprising an insert orifice receiving an insert with an insert shoulder on one end and an insert flange on the other, said insert fitting into one column or one member of said articulation joint;

a pin with a head on one end and an expansion nodule on the other, said pin's head butting against an inside of an opposing column or member of said articulation joint, the expansion nodule fitting within said insert shoulder of said insert of said opposite column or member; and an insert recession in an outer surface of said opposing column or member flushly receiving said insert flange whereby a tensioned, friction articulation of said articulation joint is formed;

a lamp centrally disposed between said right transverse and said left transverse.

* * * * *